US005460935A

United States Patent [19]

Toya

[11] Patent Number: 5,460,935

[45] Date of Patent: Oct. 24, 1995

[54] SILVER HALIDE PHOTOGRAPHIC MATERIAL

[75] Inventor: Ichizo Toya, Kanagawa, Japan

[73] Assignee: Fuji Photo Film Co., Ltd., Kanagawa, Japan

[21] Appl. No.: 199,893

[22] Filed: Feb. 22, 1994

[30] Foreign Application Priority Data

Feb. 23, 1993 [JP] Japan ..... 5-033721

[51] Int. Cl.$^6$ ..... G03C 11/16; G03C 1/035

[52] U.S. Cl. ..... 430/567; 430/569; 430/642; 430/963; 430/401; 354/299

[58] Field of Search ..... 430/567, 569, 430/642, 963, 401; 354/299

[56] References Cited

U.S. PATENT DOCUMENTS 4,826,757 5/1989 Yamada et al. ..... 430/567

5,252,442 10/1993 Dickerson et al. ..... 430/567

*Primary Examiner*—Charles L. Bowers, Jr.

*Assistant Examiner*—Mark F. Huff

*Attorney, Agent, or Firm*—Sughrue, Mion, Zinn, Macpeak & Seas

[57] ABSTRACT

A silver halide photographic material is disclosed which is processed by an automatic processor having a drying zone where drying is conducted by a heat transfer medium of 75° C. or higher, wherein the photographic material has at least one silver halide emulsion layer, and at least one silver halide emulsion having a tabular degree of at least 25 is contained in at least one layer of the silver halide emulsion layers.

10 Claims, No Drawings

SILVER HALIDE PHOTOGRAPHIC MATERIAL

FIELD OF THE INVENTION

This invention relates to a silver halide photographic material which is processed by an automatic processor having a drying zone where drying is carried out by a heat transfer medium of 75° C. or higher.

BACKGROUND OF THE INVENTION

It has been highly demanded to conduct rapid processing in the medical field in recent years. Accordingly, methods for rapidly drying in automatic processors have been applied.

SUMMARY OF THE INVENTION

An object of the present invention is to provide a photographic material which does not form reflective spotted mark when processed in an automatic processor having a drying zone provided with a heat transfer medium for conducting rapid drying.

The above-described object of the present invention has been achieved by providing a silver halide photographic material which is processed by an automatic processor having a drying zone where drying is conducted by a heat transfer medium of 75° C. or higher, wherein the photographic material has at least one silver halide emulsion layer, and at least one silver halide emulsion having a tabular degree of at least 25 is contained in at least one layer of the silver halide emulsion layers.

DETAILED DESCRIPTION OF THE INVENTION

Now, the present invention will be illustrated in greater detail below.

The effect of the present invention is more remarkable, the rapider the rate of drying. Namely, the effect of the present invention is more remarkable, the higher the temperature of the heat transfer medium. The drying means of the present invention may be used in combination with conventional warm air of 60° C. or lower.

An example of the heat transfer medium of 75° C. or higher which can be used in the present invention includes a heat roller. Examples of the heat roller include those described in JP-A-3-132659 (the term "JP-A" as used herein means an "unexamined published Japanese patent application"), JP-A-3-131854, JP-A-2-140741 and Japanese Patent Application Nos. 3-235047 and 2-280227.

It is preferred that the heat roller has such a structure that the outer periphery part of the hollow roll made of aluminum is covered with silicone rubber, polyurethane or Teflon (available from E.I. du Pont de Nemours & Co., Inc.). It is also preferred that both ends of the heat roller are rotatably supported on the side wall of the drying part by means of bearings made of a heat-resistant resin (e.g., Rulon, available from Dixon Corp.), said side wall being provided in the inside of the drying zone in the vicinity of the conveying ports of the drying zone. Further, it is preferred that a gear is fixed to one end of the heat roller, and the heat roller is rotated in the conveying direction by a driving means and a driving transmitting means. Furthermore, it is preferred that a halogen heater is provided in the inside of the roller of the heat roller, and the halogen heater is connected to a temperature controller provided in the automatic processor. A thermistor is provided on the outer periphery surface of the heat roller and connected to the temperature controller. It is preferred that the on-off control of the halogen heater is made by the temperature controller so that the temperature detected by the thermistor is 75° to 150° C., preferably 80° to 130° C.

The heat transfer medium of 75° C. or higher can be used in combination with a radiator having a radiation temperature of 150° C. or higher.

The heat transfer medium of 75° C. or higher provides an advantageous means for drying the whole zone during rapid processing (the time in the drying zone is preferably 7 seconds or shorter), but this method has a serious disadvantage in that reflective spotted marks are formed.

The contacting time (the total of the time when the photographic material keeps in contact with the heat transfer medium in the drying zone of an automatic processor) is preferably 7 seconds or less.

Polyhydroxybenzene compounds (e.g., hydroquinone) can be used in the present invention, for example, for improving resistance to pressure.

Examples of hardening agents which can be used in the present invention include aldehyde compounds; active halogen compounds described in U.S. Pat. No. 3,288,775; compounds having a reactive ethylenically unsaturated bond described in U.S. Pat. No. 3,635,718; epoxy compounds described in U.S. Pat. No. 3,091,537; and organic compounds such as halogenocarboxy aldehydes and mucochloric acid. Of these compounds, vinylsulfone hardening agents are particularly preferred. Further, high-molecular hardening agents can be preferably used. The added amount of the hardening agent is generally from $10^{-4}$ to 1 mol, preferably from $10^{-3}$ to 0.1 mol, per 100 g of gelatin.

It is preferred that silver halide grains used in the present invention are tabular grains.

The tabular degree of the silver halide emulsions used in the present invention is defined by tabular degree= $D/t^2$ wherein D is a mean value (in the unit of μm) of the diameters of the grains when the diameter of the grain is defined as the diameter of a circle having an area equal to the projected area of the grain, and the average of the diameters is referred to as a mean grain size; and t is a mean value (in the unit of μm) of the thicknesses of the grains.

The projected area and the thickness of the individual grain can be obtained based on a picture of an emulsion taken according to a shadow method by means of TEM (transmission electron microscope). The emulsion is one which contains a matting agent having a known radius. The thickness of the individual grain is evaluated by the length of the shadow which the individual grain has.

The tabular degree of the silver halide emulsion which is used in the present invention is at least 25, with the preferred upper limit being 400. The silver halide emulsion having the tabular degree of from 25 to 250 is preferred.

The thickness of the grain is preferably 0.3 μm or less, particularly preferably 0.2 μm or less, with the preferred lower limit being 0.05 μm.

Silver halides used in the silver halide emulsions of the present invention may be any of silver bromide, silver iodobromide, silver iodochlorobromide, silver chlorobromide and silver chloride. However, silver iodobromide (I=0 to 10 mol %), silver bromide and silver chlorobromide are preferred. AgI distribution may be an interior high concentration type or an exterior high concentration type. However, an exterior high concentration type is preferred.

A cadmium salt, a zinc salt, a lead salt, a thallium salt, an iridium salt or a complex salt thereof, a rhodium salt or a complex salt thereof, and an iron salt or a complex salt thereof may be optionally allowed to coexist during the formation or physical ripening of the silver halide grains. If desired, chemical sensitization may be carried out.

Examples of the chemical sensitization method include gold sensitization method using gold compounds, sensitization method using metals such as iridium, platinum, rhodium and palladium, sulfur sensitization method using sulfur-containing compounds, reduction sensitizing method using tin salts and polyamines, sensitization method using selenium compounds and sensitization method using tellurium compounds. A combination of two or more of these sensitization methods may be used.

The tabular silver halide grains can be made by the methods conventionally used.

The tabular silver halide emulsions are described in Cugnac and Chateau, *"Evolution of The Morphology of Silver Bromide Crystals during Physical Ripening", Science et Industrie Photography,* Vol. 33, No.2 (1962), pp. 121–125; Duffin, *Photographic Emulsion Chemistry* (Focal Press, New York 1966), pp. 66–72; A. P. H. Trivelli, W. F. Smith, *Photographic Journal,* Vol. 80, page 285 (1940). The tabular silver halide emulsions can be easily prepared by referring to the methods described in JP-A-58-127921, JP-A-58-113927 and JP-A-58-113928.

Further, the tabular silver halide emulsions can be prepared in the following manner. Seed crystals containing at least 40% by weight of tabular grains are formed in a relatively low pBr atmosphere having a pBr value of 1.3 or below, and the seed crystals are grown while the substantially same pBr value is kept and a silver nitrate solution and a halide solution are simultaneously added thereto.

Preferred examples of the method of preparing the tabular silver halide emulsion having the tabular degree of at least 25 include one which comprises conducting the generation of seed crystals in the presence of gelatin having a low-molecular weight, and growing the seed crystals at a pBr value of 1.3 or less while adding a silver nitrate solution and a halide solution simultaneously and increasing the added amount of the silver nitrate solution gradually.

The coating weight (in terms of silver) of the emulsions on one side is preferably 0.5 to 5 g/m$^2$ of the photographic material, more preferably 1 to 3.4 g/m$^2$ of the photographic material.

Any of additives which are conventionally used in the photographic materials can be used in the present invention without specific limitations. For example, additives described in the specification of the following JP-A-2-68539 can be used in the present invention.

| Item | Places where additives or methods are described. |
|---|---|
| 1. Silver Halide Emulsion and Preparation thereof | the 6th line from the bottom of right lower column of page 8 to the 12th line of right upper column of page 10 of JP-A-2-68539 |
| 2. Chemical Sensitization Method | the 13th line of right upper column to the 16th line of left lower column of page 10 thereof |
| 3. Anti-fogging Agent, Stabilizer | the 17th line of left lower column of page 10 to the 7th line of left upper column of page 11 thereof; and the 2nd line of left lower column of page 3 to left lower column of page 4 thereof |
| 4. Spectral Sensitizing Agent | the 4th line of right lower column of page 4 to right lower column of page 8 thereof |
| 5. Surfactant, Antistatic Agent | the 14th line of left upper column of page 11 to the 9th line of left upper column of page 12 thereof |
| 6. Matting Agent, Lubricant, Plasticizer | the 10th line of left upper column to the 10th line of right upper column of page 12 thereof; and the 10th line of left lower column to the 1st line of right lower column of page 14 thereof |
| 7. Hydrophilic Colloid | the 11th line of right upper column to the 16th line of left lower column of page 12 thereof |
| 8. Hardening Agent | the 17th line of left lower column of page 12 to the 6th line of right upper column of page 13 thereof |
| 9. Support | the 7th line to the 20th line of right upper column of page 13 thereof |
| 10. Dye, Mordant | the 1st line of left lower column of page 13 to the 9th line of left lower column of page 14 thereof |

With regard to developing solutions, fixing solutions and processing used in the present invention, reference can be made to the disclosures of JP-A-2-103037 (the 7th line of right upper column of page 16 to the 15th line of left lower column of page 19) and JP-A-2-115837 (the 5th line of right lower column of page 3 to the 10th line of right lower column of page 6).

The development temperature and time are preferably about 25° to about 50° C. for 2 to 15 sec, more preferably 30° to 40° C. for 3 to 12 sec, still more preferably 30° to 40° C. for 4 to 10 sec.

The fixing temperature and time are preferably about 20° to about 50° C. for 2 to 15 sec, more preferably 30° to 40° C. for 3 to 12 sec, still more preferably 30° to 40° C. for 4 to 10 sec as in the development.

The rinsing or stabilization temperature and time are preferably 0° to 50° C. for 2 to 15 sec, more preferably 15° to 40° C. for 2 to 10 sec, still more preferably 15° to 40° C. for 2 to 8 sec.

According to the present invention, rinsing water is squeezed off from the photographic materials after development, fixing and rinsing. Namely, the photographic materials are dried through squeeze rollers.

The drying time varies depending on ambient conditions, but is usually about 2 to 15 sec, preferably about 2 to 7 sec.

The lower the swelling ratio by percentage of the photographic material, the drying time can be more shortened. However, reflective spotted marks are liable to become noticeable. In this case, when the photographic materials of the present invention are used, a favorable effect can be obtained. It is preferred that the silver halide emulsion side of the photographic material has a swelling ratio of 250% or less, with the preferred lower limit being 130%. The photographic material having the silver halide emulsion layer side of the swelling ratio of 250% or less can be obtained by adjusting the added amount of the hardening agent, and/or selecting drying condition on the preparation of the photographic material or temperature and time for aging.

The total thickness of all layers between the outermost layer and the outermost silver halide emulsion layer on the silver halide emulsion layer side of the photographic material (including the thickness of the outermost layer and the outermost silver halide emulsion layer) is preferably 0.8 μm or smaller, with the preferred lower limit being 0.1 μm.

According to the present invention, a time taken until the photographic materials are developed, fixed, rinsed and dried, so-called Dry to Dry processing time is generally shorter than 45 sec, preferably 30 sec or shorter, most preferably 25 sec or shorter.

The term "Dry to Dry" as used herein refers to a time taken from when the top of the photographic material is just introduced into the film introducing port of the automatic processor and processed until the top of the photographic material just leaves the automatic processor.

The photographic materials of the present invention are mainly used as general-purpose black-and-white photographic materials without particular limitations. Preferably, the photographic materials of the present invention are applied to systems wherein subjects such as the human body are irradiated with X-rays, X-rays passed through the subjects are converted into visible light and the photographic materials are exposed to light, such as X-ray films for direct photographing, X-ray films for indirect photographing and films for CRT. Examples thereof include X-ray photographic materials for medical or industrial use, X-ray photographic materials for duplication and photographic materials for medical CRT images.

The present invention is now illustrated in greater detail by reference to the following examples which, however, are not to be construed as limiting the invention in any way.

EXAMPLE 1

Preparation of Tabular Grains and Thick Platy Grains

While an aqueous solution of 6 g of potassium bromide and 7 g of low-molecular gelatin having an average molecular weight of 15,000 in one liter of water was kept at 55° C. with stirring, 37 cc of an aqueous solution of silver nitrate (4.00 g of silver nitrate) and 38 cc of an aqueous solution containing 5.9 g of potassium bromide were added thereto over a period of 37 seconds by the double jet process. Subsequently, 18.6 g of gelatin was added thereto. After the temperature of the mixture was raised to 70° C., 89 cc of an aqueous solution of silver nitrate (9.8 g of silver nitrate) was added thereto over a period of 22 minutes, and 8 cc of an aqueous solution of 25% ammonia was added thereto. Physical ripening was carried out at that temperature for 10 minutes, and 7 cc of 100% acetic acid solution was added. Subsequently, an aqueous solution of 153 g of silver nitrate and an aqueous solution of potassium bromide was added thereto over a period of 35 minutes by the controlled double jet process while the pAg was kept at 8.5. Subsequently, 15 cc of 2N potassium thiocyanate solution was added. Physical ripening was carried out at that temperature for 5 minutes, and the temperature was then lowered to 35° C. There were obtained monodisperse pure silver bromide tabular grains having a mean grain size (in terms of an average diameter when the diameter of the grain is defined as the diameter of a circle having an area equal to the projected area of the grain, and the average of the diameters is referred to as a mean grain size) of 1.10 μm, a thickness of 0.166 μm and a coefficient of variation in a grain size distribution of 18%.

Soluble salts were removed by the flocculation precipitation method. The temperature of the emulsion was raised to 40° C., and 30 g of gelatin, 2.35 g of phenoxyethanol and 0.8 g of polysodium styrenesulfonate as the thickener were added thereto. The pH and Ag of the emulsion were adjusted to 5.9 and 8.00, respectively, by sodium hydroxide and a silver nitrate solution.

While the emulsion was kept at 56° C. with stirring, chemical sensitization was carried out. First, the following thiosulfinic acid compound-I ($1\times10^{-5}$ mol/mol of Ag)

$C_2H_5SO_2SNa$ was added thereto. Subsequently, 0.1 mol % of AgI fine grains was added, and further 0.043 mg of thiourea dioxide was added. The emulsion as such was kept for 22 minutes to carry out reduction sensitization. Subsequently, 20 mg of 4-hydroxy-6-methyl-1,3,3a,7-tetraazaindene and 400 mg of the following sensitizing dye-I were added.

Sensitizing Dye-I

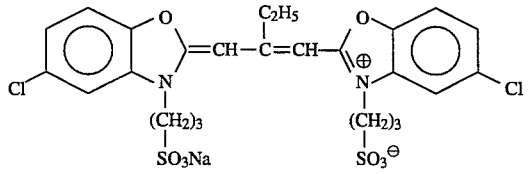

Further, 0.83 g of calcium chloride was added, and 1.3 mg of sodium thiosulfate, 1.9 mg of the following selenium compound-I, 2.6 mg of chloroauric acid and 90 mg of potassium thiocyanate were then added. After 40 minutes, the emulsion was cooled to 35° C.

Thus, the preparation of the tabular grain emulsion-C was completed.

Selenium Compound-I

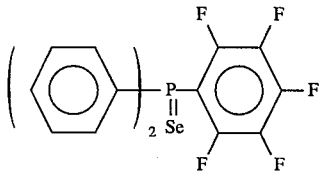

In the same manner as described above, emulsions-A, -B, -D and -E as shown in Table 1 below were prepared by changing the amounts of gelatin having an average molecular weight of 15,000, the aqueous solution of 25% ammonia and 100% acetic acid solution.

Preparation of Cubic Grains

There was dissolved 32 g of gelatin in one liter of $H_2O$. The resulting solution was heated to 70° C., and 3 g of potassium bromide was added thereto. Subsequently, 444 ml of an aqueous solution containing 80 g of silver nitrate and 452 ml of an aqueous solution containing 56 g of potassium bromide were added thereto over a period of about 20 minutes by the double jet process. Further, 400 ml of an aqueous solution containing 80 g of silver nitrate and 415 ml of an aqueous solution containing 56 g of potassium bromide were added thereto over a period of about 25 minutes by the double jet process to prepare monodisperse cubic silver bromide grains having a grain size (in terms of an average diameter of the corresponding circles) of 1 μm (a coefficient of variation in a grain size distribution of 16%).

The flocculation precipitation stage and the subsequent stages were carried out in the same manner as in the preparation of the thick platy particles except that the amount of the Sensitizing dye-I was 200 mg to obtain an emulsion-F.

Preparation of Coated Sample

The following reagents were added to prepare a coating solution for the emulsion layer-1, each amount being per mol of silver halide. Coated samples were prepared by using the coating solution.

| | |
|---|---|
| Gelatin (including Gel in the emulsion) | 108 g |
| Trimethylol Propane | 9 g |
| Dextran (average molecular weight: 39,000) | 18.5 g |
| Polysodium Styrenesulfonate (average molecular weight: 600,000) | 1.8 g |
| Hardening Agent 1,2-Bis(vinylsulfonylacetamido)ethane (amount was adjusted so as to give a swelling ratio shown in Table 3 below) | |
| Compound-I | 34 mg |
| Compound-II | 4.8 g |
| Compound-III | 15 mg |

Compound-I

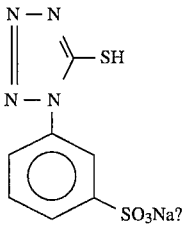

Compound-II

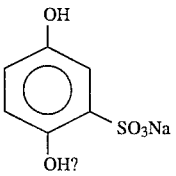

Compound-III

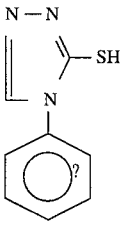

The dye emulsion (Dye Emulsion A) of the following dye-I was added to the above coating solution in such an amount as to give dye-I in an amount of 10 mg/m$^2$ per one side.

Dye-I

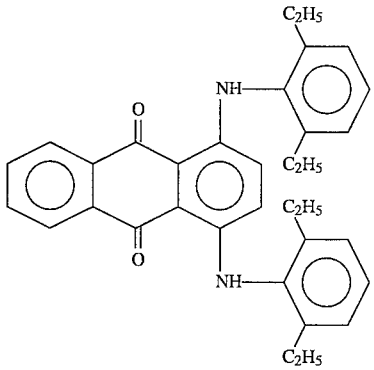

(1) Preparation of Dye Emulsion A

There were dissolved 60 g of the above dye-I, 62.8 g of the following high-boiling organic solvent-I, 62.8 g of the following high-boiling organic solvent-II and 333 g of ethyl acetate at 60° C. Subsequently, 65 cc of a 5% aqueous solution of sodium dodecylbenzenesulfonate, 94 g of gelatin and 581 cc of water were added thereto, and the mixture was emulsified and dispersed in a dissolver at 60° C. for 30 minutes. Further, 2 g of the following compound-IV and 6 liters of water were added thereto, and the temperature of the mixture was lowered to 40° C. The mixture was concentrated by using ultrafiltration Labomodule ACP 1050 (a product of Asahi Chemical Industry Co., Ltd.) to the total weight of 2 kg. One g of the compound-IV was then added thereto to obtain the dye emulsion A.

High-Boiling Organic Solvent-I

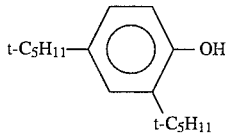

High-Boiling Organic Solvent-II

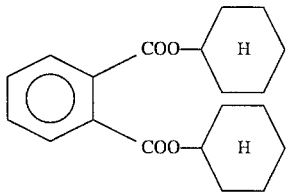

Compound-IV

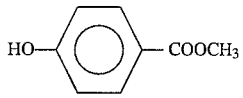

A coating solution for the surface protective layer was prepared by using the following ingredients in such an amount as to give the following coating weights.

| | |
|---|---|
| Gelatin | 0.43 g/m$^2$ |
| Polysodium Acrylate (average molecular weight: 400,000) | 0.080 g/m$^2$ |

-continued

| | |
|---|---|
| 4-Hydroxy-6-methyl-1,3,3a,7-tetraazaindene | 0.015 g/m$^2$ |
| Coating Aid-I | 0.013 g/m$^2$ |
| Coating Aid-II | 0.045 g/m$^2$ |
| Coating Aid-III | 0.0065 g/m$^2$ |
| Coating Aid-IV | 0.003 g/m$^2$ |
| Coating Aid-V | 0.001 g/m$^2$ |
| Compound-V | 1.7 mg/m$^2$ |
| Compound-VI | 100 mg/m$^2$ |
| Polymethyl Methacrylate (average particle size: 3.7 μm) | 0.087 g/m$^2$ |
| Proxel | 0.0005 g/m$^2$ |

(The pH was adjusted to 7.4 by NaOH)

Coating Aid-I

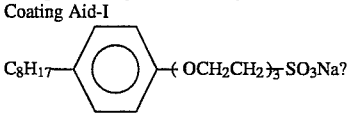

Coating Aid-II $C_{16}H_{33}O(CH_2CH_2O)_{10}H$

Coating Aid-III $C_{17}H_{33}CON(CH_3)CH_2CH_2SO_3Na$?

Coating Aid-IV $C_8F_{17}SO_2N(C_3H_7)(CH_2CH_2O)_{16}H$?

Coating Aid-V $C_8F_{17}SO_2N(C_3H_7)(CH_2CH_2O)_4(CH_2)_4SO_3Na$?

Compound-V

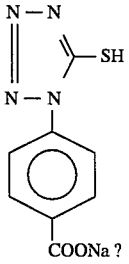

Compound-VI

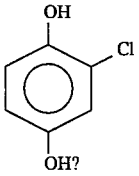

Preparation of Support (1) Preparation of Dye Dispersion B for Undercoat Layer The following dye II was subjected to a ball mill treatment according to the method described in JP-A-63-197943.

Dye-II

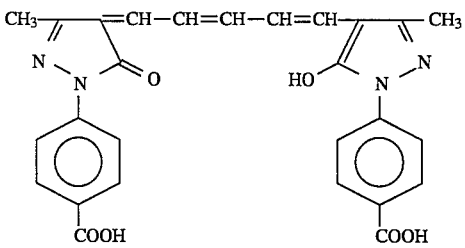

In a 2-liter ball, there were placed 434 ml of water and 791 ml of a 6.7% aqueous solution of Triton X-200 surfactant (TX-200). Subsequently, 20 g of the dye was added thereto, and further 400 ml of zirconium oxide ($ZrO_2$) beads (2 mm diameter) was added. The contents were pulverized for 4 days. Subsequently, 160 g of 12.5% gelatin was added thereto. After defoaming was conducted, $ZrO_2$ beads were removed by filtration. The resulting dye dispersion was examined by observation, and it was found that the pulverized dye particles had a wide particle size distribution ranging from 0.05 to 1.15 μm, and the average particle diameter thereof was 0.37 μm.

The dye particles having a particle size of 0.9 μm or larger were removed by centrifugal separation.

Thus, the dye dispersion B was obtained.

(2) Preparation of Support

A biaxially oriented polyethylene terephthalate film of 175 μm in thickness was subjected to a corona discharge treatment. The following first undercoating solution having the following composition was coated on the film in such an amount as to give a coating amount of 4.9 cc/m$^2$, and dried at 185° C. for one minute. The coating was conducted by means of a wire bar coater.

Subsequently, the first undercoat layer was provided on the opposite surface to the above coated surface in the same manner as described above. The polyethylene terephthalate film used contained 0.04 wt. % of the dye-I.

| | |
|---|---|
| Butadiene-Styrene Copolymer Latex Solution (solid content: 40%; butadiene/styrene = 31/69 by weight) | 158 cc |
| 4% Solution of Sodium Salt of 2,4-Dichloro-6-hydroxy-s-triazine | 41 cc |
| Distilled Water | 801 cc |

*The latex solution contained 0.4 wt % of the following compound as the emulsifying dispersant based on the amount of the latex solid.

Emulsifying Dispersant $n\text{-}C_6H_{13}OOCCH_2$ $n\text{-}C_6H_{13}OOCCH(SO_3Na)$?

The following second undercoat layer was coated on the first undercoat layer of each of both sides of the film in such an amount as to give the following coating weights. The coating was conducted one side by one side by means of a wire bar coater system. The coated film was dried at 155° C.

| | |
|---|---|
| Gelatin | 80 mg/m$^2$ |
| Dye Dispersion B (on a solid basis) | 8 mg/m$^2$ |
| Coating Aid-VI | 1.8 mg/m$^2$ |
| Compound-VII | 0.27 mg/m$^2$ |
| Matting Agent (Polymethyl Methacrylate having an average particle size of 2.5 μm) | 2.5 mg/m$^2$ |

Coating Aid-VI
$C_{12}H_{25}O(CH_2CH_2O)_{10}H$
Compound-VII

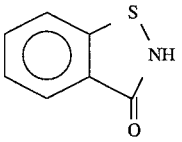

Preparation of Photographic Material

The above emulsion layer and the above surface protective layer were coated on both sides of the film by the co-extrusion method. The coating weight per one side was 1.60 g/m$^2$ in terms of silver.

Each sample was evaluated in the following manner.

Evaluation of Using Automatic Processor

Each sample was exposed with white light, and then processed using the following automatic processor.

The drying zone of the automatic processor CEPROS-M (a product of Fuji Photo Film Co., Ltd.) was reconstructed, whereby Dry to Dry 30 sec processing was made possible by changing the linear velocity.

(1) Reflective spotted mark (Degree of spotted marks in the surface of the processed film which are observable as unevenness with reflected light)

Four rollers provided on the upper part of the drying zone were used as heat rollers to provide 80° C., and the air temperature of the drying zone was raised to 45° C. The reflective spotted mark of the finished samples was visually evaluated.

The criterion is as follows:

The mark A: no spotted mark

The mark B: slightly spotted mark (practically acceptable)

The mark C: seriously spotted mark (no good)

(2) Drying Level (Dry to Dry 30 sec processing)

The mark A: dried

The mark B: insufficiently dried

The average processed amount of the photographic materials per day was about 200 sheets in terms of quarter size (10×12 inch$^2$).

The processing solutions and the replenishers used will be illustrated below.

Development

Preparation of Concentrated Solution
Developing Solution

| Part Agent A | |
|---|---|
| Potassium Hydroxide | 270 g |
| Potassium Sulfite | 1,125 g |
| sodium Carbonate | 450 g |
| Boric Acid | 75 g |
| Diethylene Glycol | 150 g |

-continued

| | |
|---|---|
| Diethylenetriaminepentaacetic Acid | 30 g |
| 1-(N,N-Diethylamino)ethyl-5-mercapto-tetrazole | 1.5 g |
| Hydroquinone | 405 g |
| 4-Hydroxymethyl-4-methyl-1-phenyl-3-pyrazolidone | 30 g |
| Add Water to make | 4,500 ml |
| Part Agent B | |
| Tetraethylene Glycol | 750 g |
| 3,3'-Dithiobishydrocinnamic Acid | 3 g |
| Glacial Acetic Acid | 75 g |
| 5-Nitroindazole | 4.5 g |
| 1-Phenyl-3-pyrazolidone | 67.5 g |
| Add Water to make | 1,000 ml |
| Part Agent C | |
| Potassium Bromide | 15 g |
| Potassium Metabisulfite | 120 g |
| Add Water to make | 750 ml |
| Fixing Solution | |
| Ammonium Thiosulfate (70 wt/vol %) | 3,000 ml |
| Disodium Ethylenediaminetetraacetate Dihydrate | 0.45 g |
| Sodium Sulfite | 225 g |
| Boric Acid | 60 g |
| 1-(N,N-Dimethylamino)ethyl-5-mercaptotetrazole | 15 g |
| Tartaric Acid | 48 g |
| Glacial Acetic Acid | 675 g |
| Sodium Hydroxide | 225 g |
| Sulfuric Acid (36 N) | 58.5 g |
| Aluminum Sulfate | 150 g |
| Add water to make | 6,000 ml |
| pH | 4.68 |

Preparation of Processing Solution

Each of the part agents of the above concentrated developing solution was separately charged into each container. These containers for the part agents A, B and C were joined to one unit by the containers themselves.

The above concentrated fixing solution was charged into the same type of a container as that for the developing solution.

Further, 300 ml of an aqueous solution containing 54 g of acetic acid and 55.5 g of potassium bromide as the starter was added to the developing tank.

The containers containing the processing solutions were inverted and inserted into the perforating blades of processing solution stock tanks provided on the side wall of the automatic processor to break the sealing film of each cap and to charge the processing solutions in the containers into the stock tanks.

These processing solutions in the following amounts were charged into the developing tank and the fixing tank of the automatic processor by means of pumps provided on the processor.

The stock solutions of the processing solutions in the following proportions were mixed with water and charged into the processing tanks of the processor every time 25 sheets of the photographic materials in terms of quarter size were processed.

| Developing Solution | |
|---|---|
| Part Agent A | 60 ml |
| Part Agent B | 13.4 ml |

-continued

| | |
|---|---|
| Part Agent C | 10 ml |
| Water | 116.6 ml |
| pH | 10.50 |
| Fixing Solution | |
| Concentrated Solution | 80 ml |
| Water | 120 ml |
| pH | 4.62 |

The rinsing tank was charged with tap water.

Measurement of Swelling Ratio

The swelling ratio was measured by so-called Cryo-SEM method wherein the thickness (I) of the hydrophilic binder is measured by SEM, and the swollen thickness (L) is measured by SEM after being immersed in $H_2O$ at 21° C. for 3 minutes and then freeze-dried.

$$\text{Swelling ratio}=(L-I)\div(I)\times 100\%$$

EXAMPLE 2

In the same manner as in Example 1, samples 25 to 30 having the following layer structure were prepared.

Layer Structure:

The emulsion layer-1, the emulsion layer-2 and the surface protective layer in this order from the side of the support were coated.

Coating Solution for Emulsion Layer-1:

The same as that for the emulsion layer-1 of example 1 (except that emulsion-E was used).

Coating Solution for Emulsion Layer-2:

The same as that for the emulsion layer-1 of Example 1 (except that emulsions shown in Table 3 below were used).

Surface Protective Layer:

The same as that of Example 1.

The emulsion layers-1 and -2 were coated in the same manner as in Example 1, and the coating weight of Ag in the emulsion layers-1 and -2 was the same.

TABLE 1

| Emulsion | Form | Diameter of Terms of the Diameter of the Corresponding Circle D (μm) | Thickness t (μm) | Tabular Degree $D/t^2$ | Coefficient of Variation in Grain Size Distribution |
|---|---|---|---|---|---|
| Emulsion-A | tabular | 1.4 | 0.137 | 74.6 | 25% |
| Emulsion-B | " | 1.3 | 0.156 | 53.4 | 20 |
| Emulsion-C | " | 1.1 | 0.166 | 40.0 | 18 |
| Emulsion-D | " | 1.1 | 0.190 | 30.5 | 18 |
| Emulsion-E | thick platy | 1.2 | 0.265 | 17.1 | 20 |
| Emulsion-F | cubic | 1.0 | 0.886 | 1.3 | 16 |

TABLE 2

| Sample | Emulsion Layer-1 | Thickness of Surface Protective Layer (μm) | Swelling Ratio (%) | Drying Level | Reflective Spotted Mark |
|---|---|---|---|---|---|
| 1 (Invention) | A | 1 | 230 | A | A |
| 2 (") | B | " | " | A | A |
| 3 (") | C | " | " | A | A |
| 4 (") | D | " | " | A | A |
| 5 (Comp. Ex.) | E | " | " | A | B |
| 6 (") | F | " | " | A | B |
| 7 (Invention) | A | 0.7 | " | A | A |
| 8 (") | B | " | " | A | A |
| 9 (") | C | " | " | A | A |
| 10 (") | D | " | " | A | A |
| 11 (Comp. Ex.) | E | " | " | A | B |
| 12 (") | F | " | " | A | C |
| 13 (Invention) | A | 0.45 | " | A | A |
| 14 (") | B | " | " | A | A |
| 15 (") | C | " | " | A | A |
| 16 (") | D | " | " | A | A |
| 17 (Comp. Ex.) | E | " | " | A | C |
| 18 (") | F | " | " | A | C |
| 19 (Invention) | A | 0.45 | 290 | B | A |
| 20 (") | B | " | " | B | A |
| 21 (") | C | " | " | B | A |
| 22 (") | D | " | " | B | A |
| 23 (Comp. Ex.) | E | " | " | B | B |
| 24(") | F | " | " | B | B |

It is apparent from the results shown in Table 2 that the samples of the present invention are superior.

TABLE 3

| Sample | Emulsion Layer-1 | Emulsion Layer-2 | Thickness of Surface Protective Layer | Swelling Ratio (%) | Drying Level | Reflective Spotted Mark |
|---|---|---|---|---|---|---|
| 25 (Invention) | Emulsion-E | Emulsion-A | 0.7 | 230 | A | A |
| 26 (") | " | Emulsion-B | " | " | A | A |
| 27 (") | " | Emulsion-C | " | " | A | A |
| 28 (") | " | Emulsion-D | " | " | A | A |
| 29 (Comp. Ex.) | " | Emulsion-E | " | " | A | B |
| 30 (Invention) | " | Emulsion-F | " | " | A | C |

It is apparent from the results shown in Table 3 that the samples of the present invention are superior.

EXAMPLE 3

Preparation of Emulsion

To an aqueous solution of 6.2 g of gelatin having an average molecular weight of 15,000 and 6.9 g of potassium bromide in one liter of water kept at 49° C. with stirring, there were added an aqueous solution of 4.0 g of silver nitrate and an aqueous solution containing 5.9 g of potassium bromide over a period of 37 seconds by the double jet process. Subsequently, an aqueous solution containing 18.6 g of gelatin was added thereto, and the temperature of the mixture was then raised to 64° C. while an aqueous solution containing 9.8 g of silver nitrate was added thereto over a period of 22 minutes. Further, 4.2 c of an aqueous solution of 25% ammonia was added. After 10 minutes, an aqueous solution containing 3.9 g of acetic acid was added thereto. Subsequently, an aqueous solution of 151 g of silver nitrate and an aqueous solution of potassium bromide were added thereto over a period of 35 minutes by the controlled double jet process while the potential was kept at a pAg of 8.8. In this case, the addition was made at such an accelerating flow rate that the flow rate at the time of completion of the addition was 14 times the flow rate at the time of the commencement of the addition. When 33 minutes elapsed during the addition by the controlled double jet process, an aqueous solution of 0.05 g of $K_3IrCl_6$ was added thereto. After completion of the addition, 45 cc of a 2N potassium thiocyanate solution was added thereto, and the temperature was lowered to 35° C. After soluble salts were removed by the flocculation precipitation method, the temperature of the resulting emulsion was raised to 40° C., and 35 g of gelatin, 85 mg of Proxel and a thickener were added thereto. The pH and Ag of the emulsion were adjusted to 6.0 and 7.8 by sodium hydroxide, potassium bromide, and an aqueous solution of silver nitrate, respectively. The temperature of the emulsion was raised to 56° C., and 0.1 mol % (based on the total amount of silver) of fine AgI grains having a diameter of 0.07 μm was added thereto. Further, 198 mg of 4-hydroxy-6-methyl-1,3,3a,7-tetraazaindene and 426 mg of the dye-I were added thereto. After 10 minutes, the following selenium compound-II ($0.52\times10^{-5}$ mol per mol of Ag), sodium thiosulfate ($1.03\times10^{-5}$ mol per mol of Ag), 30 mg of potassium thiocyanate and 6 mg of chloroauric acid were added thereto, and the emulsion was ripened for 50 minutes. The emulsion was solidified by quenching to obtain the emulsion-I. The resulting grains had a mean grain size (when the diameter of the grain is defined as the diameter of a circle having an area equal to the projected area of the grain, and the average of the diameters is referred to as a mean grain size) of 0.8 μm, a standard deviation of 17% and an average thickness of 0.152 μm.

Dye-I

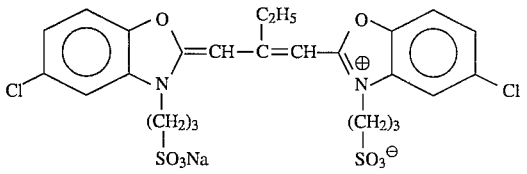

Proxel

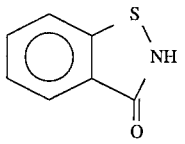

Selenium Compound-II

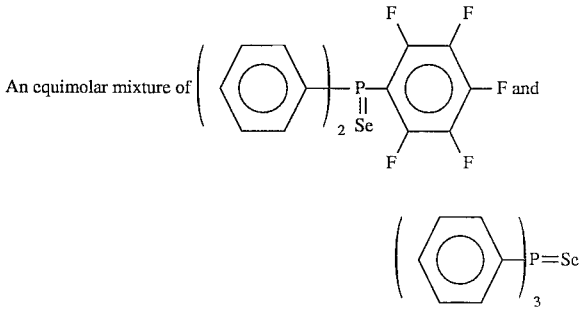

In the same manner as described above, emulsions-G, -H, -J and -K shown in Table 4 below were prepared by changing the amounts of gelatin having an average molecular weight of 15,000, the aqueous solution of 25% ammonia and the acetic acid solution.

Preparation of Cubic Grains

There was dissolved 32 g of gelatin in one liter of $H_2O$, and 2.7 g of potassium bromide was added to the resulting solution heated to 62° C. To the resulting solution, there were added 444 ml of an aqueous solution containing 80 g of silver nitrate and 452 ml of an aqueous solution containing 56 g of potassium bromide over a period of about 20 minutes by the double jet process. Subsequently, 400 ml of an aqueous solution containing 80 g of silver nitrate and 415 ml of an aqueous solution containing 56 g of potassium bromide over a period of about 25 minutes by the double jet process to prepare monodisperse cubic silver bromide grains having a grain size (in terms of the diameter of the corresponding circle) of 0.7 μm (a coefficient of variation in a grain size distribution of 15%).

The flocculation precipitation stage and the subsequent stages were carried out in the same manner as in the preparation of the thick platy grains except that the amount of the sensitizing dye-I was 220 mg, thereby obtaining the emulsion-L.

TABLE 4

| Emulsion | Form | Diameter in Terms of the Diameter of the Corresponding Circle D (μm) | Thickness t (μm) | Tabular Degree $D/t^2$ | Coefficient of Variation in a Grain Size Distribution (%) |
|---|---|---|---|---|---|
| Emulsion-G | tabular | 0.7 | 0.110 | 57.9 | 18 |
| Emulsion-H | " | 0.7 | 0.122 | 47.0 | 18 |
| Emulsion-I | " | 0.8 | 0.152 | 34.6 | 17 |
| Emulsion-J | " | 0.8 | 0.167 | 28.7 | 17 |
| Emulsion-K | thick platy | 0.7 | 0.220 | 14.5 | 20 |
| Emulsion-L | cubic | 0.7 | 0.620 | 1.8 | 15 |

Preparation of Coating Solution for Emulsion Layer Side

1. Coating solution for Emulsion Layer

The following reagents were added to the chemically sensitized emulsion to prepare a coating solution, each amount being per mol of silver halide.

| | |
|---|---|
| 2,6-Bis(hydroxyamino)-4-diethylamino-1,3,5-triazine | 72.0 mg |
| Dextran (average molecular weight: 39,000) | 3.9 g |
| Polypotassium Styrenesulfonate (average molecular weight: 600,000) | 0.7 g |
| Additive-I | 7.0 mg |
| Sodium Hydroquinonemonsulfonate | 8.2 g |
| Snowtex (a product of Nissan Chemical Industries, Ltd.) | 10.5 g |
| Ethyl Acrylate/Methacrylic Acid (97/3) Copolymer Latex | 9.7 g |
| Gelatin | The amount was adjusted so that the coating weight of the emulsion layer was 2.6 g/m². |
| Hardening Agent | (1,2-bis(vinylsulfonylacetamido)ethane) The amount was adjusted so as to give a swelling ratio of 205%. |

2. Coating Solution for Surface Protective Layer

A coating solution b-1 was prepared so that each component gave the following coating weight.

| | |
|---|---|
| Gelatin | 370 mg/m² |
| Polysodium Acrylate (average molecular weight: (400,000) | 18 mg/m² |
| Butyl Acrylate/Methacrylic Acid (4/6) Copolymer Latex (average molecular weight: 120,000) | 120 mg/m² |
| Coating Aid-I | 18 mg/m² |
| Coating Aid-II | 45 mg/m² |
| Coating Aid-IV | 0.9 mg/m² |
| Coating Aid-V | 0.61 mg/m² |
| Coating Aid-VII | 26 mg/m² |
| Additive-II | 1.3 mg/m² |
| Polymethyl Methacrylate (average particle size: 2.5 μm) | 87 mg/m² |
| Proxel | 0.5 mg/m² |
| Polypotassium styrenesulfonate (average molecular weight: 600,000) | 0.9 mg/m² |

The pH was adjusted to 7.4 by NaOH.

Additive-I

-continued

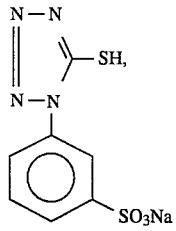

Additive-II

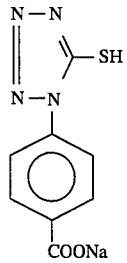

Coating Aid-I

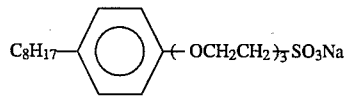

Coating Aid-II $C_{16}H_{33}O(CH_2CH_2O)_{10}H$

Coating Aid-IV

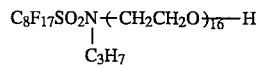

Coating Aid-V

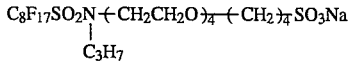

Coating Aid-VII

-continued

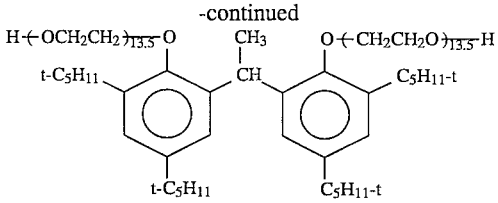

Preparation of Coating Solution for Back Side

1. Coating Solution of Antihalation Layer (1) Preparation of Dye Dispersion L

There were dissolved 2.5 g of the following dye-II, 2.5 g of the following Oil-I and 2.5 g of the following Oil-II in 50 cc of ethyl acetate. The resulting solution was mixed with 90 g of an 8% aqueous solution of gelatin containing 1.5 g of sodium dodecylbenzenesulfonate and 0.18 g of methyl p-hydroxybenzoate at 60° C. The mixture was stirred in a homogenizer at a high speed. After high speed stirring, the mixture was subjected to a vacuum treatment at 60° C. in an evaporator to thereby remove 92 wt. % of ethyl acetate, thus obtaining the dye dispersion-L having an average particle size of 0.18 μm.

(2) Preparation of Coating Solution

A coating solution was prepared so that each component gave the following coating weight.

| | |
|---|---|
| Gelatin | 2.0 g/m$^2$ |
| Phosphoric Acid | 5.2 mg/m$^2$ |
| Snowtex C (a product of Nissan Chemical Industries, Ltd.) | 0.5 g/m$^2$ |
| Ethyl Acrylate/Methacrylic Acid (97/3) Copolymer Latex | 0.5 g/m$^2$ |
| Proxel | 4.2 mg/m$^2$ |
| Dye Dispersion-L | 8.0 g/m$^2$ |
| Dye-III | 75 mg/m$^2$ |
| Dye-IV | 50 mg/m$^2$ |
| Dye-V | 50 mg/m$^2$ |
| Hardening Agent (1,2-bis(vinylsulfonylacetamido)-ethane) | 40 mg/m$^2$ |

Dye-II

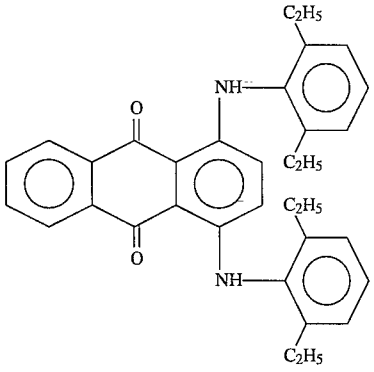

Dye-III

-continued

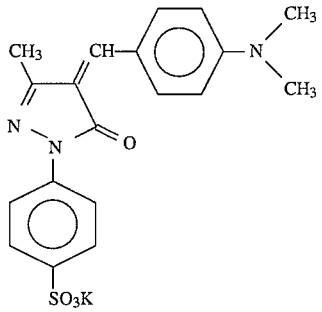

Dye-IV

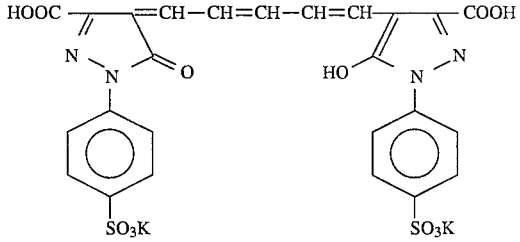

Dye-V

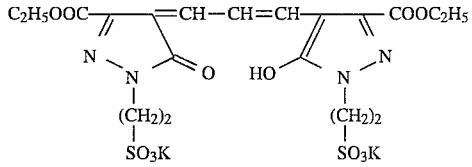

Oil-I

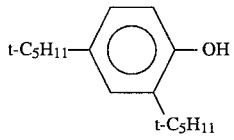

Oil-II

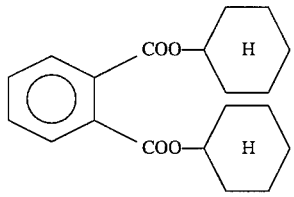

Surface Protective Layer

A coating solution was prepared so that each component gave the following coating weight.

| | |
|---|---|
| Gelatin | 1,000 mg/m$^2$ |
| Polymethyl Methacrylate (average particle size: 3.5 μm) | 20 mg/m$^2$ |
| (average particle size: 0.75 μm) | 81 mg/m$^2$ |
| Coating Aid-I | 20 mg/m$^2$ |
| Coating Aid-II | 40 mg/m$^2$ |
| Coating Aid-IV | 6 mg/m$^2$ |
| Coating Aid-V | 9 mg/m$^2$ |
| Coating Aid-VIII | 1.7 mg/m$^2$ |
| Coating Aid-IX | 13 mg/m$^2$ |
| Proxel | 1.3 mg/m$^2$ |
| Polypotassium Styrenesulfonate (average molecular weight: 600,000) | 6 mg/m$^2$ |

-continued

| | |
|---|---|
| NaOH | 2.5 mg/m$^2$ |

Coating Aid-VIII
$C_8H_{17}SO_3K$
Coating Aid-IX?

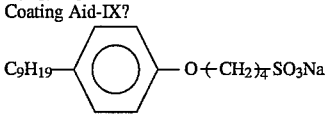

Preparation of Support

A biaxially oriented polyethylene terephthalate film of 183 μm in thickness was subjected to a corona discharge treatment. A first undercoating solution having the following composition was coated on the film in such an amount as to give a coating amount of 5.1 cc/m$^2$. The coating was conducted by means of a wire bar coater. The coated film was dried at 175° C. for one minute.

In the same manner as described above, a first undercoat layer was provided on the opposite side to the above coated side. The polyethylene terephthalate contained 0.04 wt. % of the dye-II.

| | |
|---|---|
| Butadiene-Styrene Copolymer Latex Solution (solid content: 40%; butadiene/styrene = 31/69 by weight) | 79 cc |
| 4% Aqueous Solution of Sodium Salt of 2,4-Dichloro-6-hydroxy-s-triazine | 20.5 cc |
| Distilled Water | 900.5 cc |

The latex solution contained 0.4 wt. % of the following emulsifying dispersant based on the amount of latex solid.

Emulsifying Dispersant

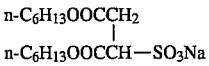

Preparation of Photographic Material

The antihalation layer and the surface protective layer were coated on the back side of the support. Subsequently, the emulsion layer and the surface protective layer (coating solution b-1) were coated on the opposite side of the support to the back side by a co-extrusion method. The coating weight of silver on the emulsion layer side was 2.7 g/m$^2$.

Evaluation by Automatic Processor

The same as in Example 1. The results obtained are shown in Table 5 below.

TABLE 5

| Sample | Emulsion Layer-1 | Thickness of Surface Protective Layer (μm) | Swelling Ratio (%) | Drying Level | Reflective Spotted Mark |
|---|---|---|---|---|---|
| 31 (Invention) | G | 1 | 205 | A | A |
| 32 (") | H | " | " | A | A |
| 33 (") | I | " | " | A | A |
| 34 (") | J | " | " | A | A |

TABLE 5-continued

| Sample | Emulsion Layer-1 | Thickness of Surface Protective Layer (μm) | Swelling Ratio (%) | Drying Level | Reflective Spotted Mark |
|---|---|---|---|---|---|
| 35 (Comp. Ex.) | K | " | " | A | B |
| 36 (") | L | " | " | A | B |
| 37 (Invention) | G | 0.7 | " | A | A |
| 38 (") | H | " | " | A | A |
| 39 (") | I | " | " | A | A |
| 40 (") | J | " | " | A | A |
| 41 (Comp. Ex.) | K | " | " | A | B |
| 42 (") | L | " | " | A | C |
| 43 (Invention) | G | 0.45 | " | A | A |
| 44 (") | H | " | " | A | A |
| 45 (") | I | " | " | A | A |
| 46 (") | J | " | " | A | A |
| 47 (Comp. Ex.) | K | " | " | A | C |
| 48 (") | L | " | " | A | C |

It is apparent from the results shown in Table 5 that the samples of the present invention are superior.

While the present invention has been described in detail and with reference to specific embodiments thereof, it is apparent to one skilled in the art that various changes and modifications can be made therein without departing from the spirit and the scope of the present invention.

What is claimed is:

1. A method for preventing formation of reflective spotted marks during rapid drying, comprising providing a silver halide photographic material which has at least one silver halide emulsion layer, wherein at least one silver halide emulsion having a tabular degree of at least 25 is contained in at least one layer of the at least one silver halide emulsion layer;

processing the silver halide photographic material with an automatic processor having a drying zone where drying is conducted by a heat roller at 75° C. or higher.

2. A method as in claim 1, wherein the at least one silver halide emulsion has a tabular degree of 25 to 250.

3. A method as in claim 1, wherein the photographic material has an emulsion layer side which includes the at least one silver halide emulsion layer, wherein the silver halide emulsion layer side of the photographic material has a swelling ratio of 250% or less.

4. A method as in claim 1, wherein the photographic material has an emulsion layer side which includes the at least one silver halide emulsion layer, wherein the silver halide emulsion layer side of the photographic material has a swelling ratio of 130 to 250%.

5. A method as in claim 1, wherein the photographic material has an emulsion layer side which includes an outermost layer and an outermost silver halide emulsion layer, wherein all layers between the outermost layer and the outermost silver halide emulsion layer have a total thickness of 0.8 μm or smaller.

6. A method as in claim 1, wherein the photographic material has an emulsion layer side which includes an outermost layer and an outermost silver halide emulsion layer, wherein all layers between the outermost layer and the outermost silver halide emulsion layer have a total thickness of from 0.1 to 0.8 μm.

7. A method as in claim 1, wherein the photographic material has a residence time of 7 seconds or shorter in the drying zone.

8. A method as in claim 1, wherein the at least one silver halide emulsion comprises silver halide grains of silver iodobromide having an iodide content of not more than 10 mol %, silver bromide or silver chlorobromide.

9. A method as in claim 1, wherein one side of the photographic material has a coated silver amount of from 0.5 to 5 $g/m^2$.

10. A method for drying a photographic material with a heat roller, comprising providing a silver halide photographic material which has at least one silver halide emulsion layer, wherein at least one silver halide emulsion having a tabular degree of at least 25 is contained in at least one layer of the at least one silver halide emulsion layer;

processing the silver halide photographic material with an automatic processor having a drying zone where drying is conducted by a heat roller at 75° C. or higher.

* * * * *